United States Patent [19]

Kubota et al.

[11] Patent Number: 4,992,772

[45] Date of Patent: Feb. 12, 1991

[54] METAL OXIDE FILM RESISTOR

[75] Inventors: Itaru Kubota; Kazuyuki Oshima; Koichi Mizozoe; Yoshiyuki Aoshima; Toshiya Nakamura, all of Tokyo, Japan

[73] Assignee: Taiyo Yuden Co., Ltd., Tokyo, Japan

[21] Appl. No.: 323,567

[22] Filed: Mar. 13, 1989

[30] Foreign Application Priority Data

Mar. 14, 1988 [JP] Japan ..... 63-59841
Dec. 28, 1988 [JP] Japan ..... 63-328870

[51] Int. Cl.[5] ..... H01C 1/012
[52] U.S. Cl. ..... 338/308; 338/309
[58] Field of Search ..... 338/308, 309, 314; 427/101, 102, 103

[56] References Cited

U.S. PATENT DOCUMENTS 2,662,957 12/1953 Eisler ..... 427/103 X
2,920,005 1/1960 Dearden ..... 427/103
3,217,281 11/1965 Griest et al. ..... 427/103 X
4,091,144 5/1978 Dresner et al. ..... 338/308 X
4,215,020 7/1980 Wahlers et al. ..... 338/21 X
4,540,463 9/1965 Kakuhashi et al. ..... 427/103 X
4,737,757 4/1988 Senda et al. ..... 338/308
4,756,756 7/1988 Cassat ..... 427/101 X

FOREIGN PATENT DOCUMENTS 63-62301 3/1988 Japan .

*Primary Examiner*—Bruce A. Reynolds
*Assistant Examiner*—M. Lateef
*Attorney, Agent, or Firm*—Frishauf, Holtz Goodman & Woodward

[57] ABSTRACT

A two-layered metal oxide film resistor having a ceramic substrate which has on its surface a first thin (0.1-5 μm) metal oxide film that is based on tin oxide and which has a minor proportion of at least one auxiliary component selected from iron, indium, nickel, phosphorus, zinc, cadmium and antimony, and a second thin (0.003-1 μm) metal oxide film superposed on the first film that is also based on tin oxide but which contains a minor proportion of at least one auxiliary component selected from antimony, nickel, chromium, fluorine, phosphorus, arsenic, iron, manganese, barium, bismuth, cobalt, zinc, copper, boron, cadmium and vanadium.

23 Claims, 1 Drawing Sheet

METAL OXIDE FILM RESISTOR

BACKGROUND OF THE INVENTION

The present invention relates to a metal oxide film resistor having a tin oxide based metal oxide film coated on the surface of an electrically insulating substrate.

Conventional metal oxide film resistors are fabricated by the following procedures: a tin oxide based metal oxide film is formed on the surface of a typically rod-shaped ceramic substrate 1.5-2 mm in diameter and 5-6 mm in length); a metallic terminal cap is fitted over each end of the coated substrate to provide a connecting terminal; a wire lead is attached to each terminal cap; and the entire assembly except the leads is encapsulated by an electrically insulating and moisture-proof protective sheath. In order to reduce the temperature coefficient of resistance, antimony oxide is usually added to the tin oxide based metal oxide film.

In forming a metal oxide film on the surface of an insulating substrate in the manufacture of conventional metal oxide film resistors, a "spray method" is commonly employed. In the "spray method", a feed solution having stannic chloride ($SnCl_4$) and a small amount of antimony trichloride ($SbCl_3$) dissolved in a mixed solvent of water, HCl, alcohol, etc. is prepared and rods of a mullite-corundum ceramic substrate are supplied into a film depositing apparatus, the essential part of which is shown in FIG. 3, and a metal oxide film is deposited on the surfaces of the substrate rods to make metal oxide film resistors.

The apparatus shown in FIG. 3 comprises a furnace 6 that has a heat-resistant drum 7 mounted rotatably around a shaft and which has a heating element fitted in the furnace wall to ensure uniform heating of the drum. Outside the furnace are provided a feed solution supply unit 8 and an air compressing unit 9. The feed solution supply unit 8 and the air compressing unit 9 are connected to the drum 7 via pipes 11 and 12, respectively. The pipes 11 and 12 end with a nozzle 10 through which the feed solution is sprayed towards the drum.

Film deposition with the apparatus shown in FIG. 3 will proceed as follows: the feed solution is charged into the unit 8 and the mullite-corundum ceramic rods a are charged into the rotating drum 7; as the temperature in the furnace is elevated to 500°-800° C., the feed solution carried with compressed air is sprayed through the nozzle 10 to be deposited on the surfaces of the ceramic rods; thereafter, the spraying and heating operations are turned off and the substrate rods are taken out of the furnace. The recovered rods are transferred into a separate furnace where they are given a heat treatment at 200°-300° C. for a period ranging from several tens of minutes to several hours to form a thermally and electrically stable metal oxide film.

Subsequently, a metallic cap is fitted over each end of the substrate and a helix is cut through the film into the substrate to obtain a desired value of resistance. A wire lead is then welded to each cap and a protective coating is applied to make a final product of metal oxide film resistor.

The prior art metal oxide film resistors fabricated by the process described above have had the disadvantage that because of problems such as low stability and reliability of coated films, the values of resistance that can be attained before cutting the helix are only up to about 200 ohms. In the absence of helical cuts into the film on a substrate having dimensions comparable to those employed previously, higher values of resistance could be attained by decreasing the thickness of a metal oxide film to be formed on the substrate. However, this approach suffers from the disadvantage of variations in other characteristics of the resistor such as the increase in the temperature coefficient of resistance and the decrease in thermal stability, which lead to increases in the amount of change in resistance as a result of soldering of wire leads or exposure to high temperatures. Because of these limitations, the method of increasing the value of resistance by reducing the thickness of a metal oxide film has been unable to produce commercially acceptable high-resistance metal oxide film resistors.

SUMMARY OF THE INVENTION

An object, therefore, of the present invention is to provide a metal oxide film resistor that is free from the above-mentioned problems of the prior art products.

In order to attain this object, the present inventors have developed an improved version of metal oxide film resistors of a type in which a tin oxide based metal oxide film is coated on the surface of a ceramic substrate, with a connecting terminal being fitted over each end of the coated ceramic substrate. The improvement is characterized in that the metal oxide film is formed of two dissimilar layers in superposition. The metal oxide film resistor of the present invention comprises a ceramic substrate having a first metal oxide film layer formed on its surface, and this first metal oxide film layer is overlaid with a second metal oxide film layer having a smaller specific resistance.

DETAILED DESCRIPTION OF THE INVENTION

The first metal oxide film in the metal oxide film resistor of the present invention can be formed as a thin layer which comprises tin oxide and which contains a small amount of at least one auxiliary component selected from the group consisting of iron, indium, nickel, phosphorus, zinc, cadmium and antimony. The auxiliary component is an additive which, when present in a very small amount, is effective in increasing the specific resistance of the first metal oxide layer without impairing its crystallinity. The present inventors confirmed by experiments that all of the elements listed above possessed these characteristics and particularly good results were attained when at least one element selected from the group consisting of iron, indium, nickel and phosphorus was incorporated in the first metal oxide film.

The amounts of elements to be incorporated in the first metal oxide film deposited on the substrate are such that the ratio of the number of tin atoms to the total number of atoms of the elements incorporated will be in the range of 1:0.001-1:0.4, preferably 1:0.003-1:0.15.

The first metal oxide film may have an average thickness of 0.1-5 μm, preferably 0.5-2 μm.

As explained hereinafter, however, it has been found later that the first metal oxide film can have an extended range of average thickness of 0.02-5 μm, preferably 0.05-2 μm.

The second metal oxide film in the metal oxide film resistor of the present invention can be formed as a thin layer which comprises tin oxide and which contains a small amount of at least one auxiliary component selected from the group consisting of antimony, nickel, chromium, fluorine, phosphorus, arsenic, iron, manganese, barium, bismuth, cobalt, zinc, copper, boron, cadmium and vanadium. The auxiliary component is an additive which, when incorporated in the second metal oxide film, is effective in adjusting the specific resistance of that layer without impairing its crystallinity. The present inventors confirmed by experiments that all of the elements listed above possessed these characteristics and particularly good results were attained when at least one element selected from the group consisting of antimony, nickel, fluorine and chromium, preferably selected from the group consisting of antimony, nickel and chromium was incorporated in the second metal oxide film.

The amounts of elements to be incorporated in the second metal oxide film deposited on the first metal oxide film are such that the ratio of the number of tin atoms to the total number of atoms of the elements incorporated will be in the range of 1:0.0001-1:0.2, preferably 1:0.005-1:0.1.

The second metal oxide film may have an average thickness of 0.003-1 μm, preferably 0.005-0.5 μm.

Figure 1:
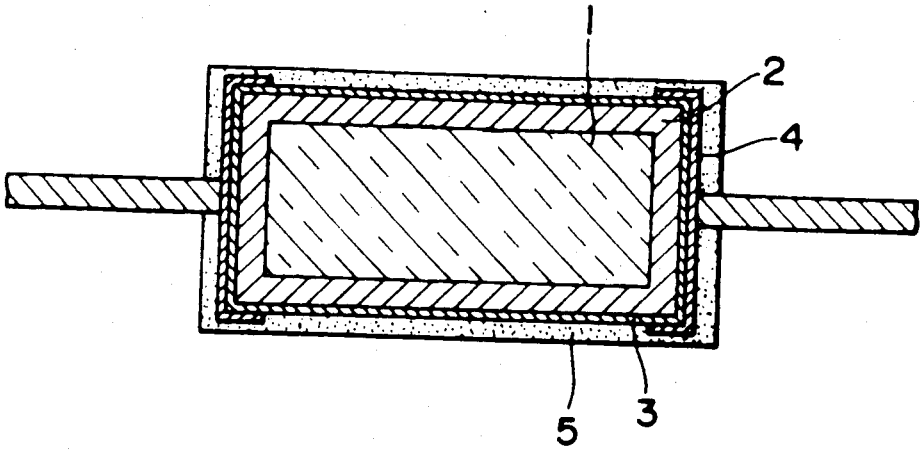
FIG. 1 is a cross-sectional view of the metal oxide film resistor of the present invention.

In accordance with the present invention, as illustrated in FIG. 1 the first metal oxide film 2 is formed by applying material of a high specific resistance in a comparatively large thickness on the surface of a ceramic substrate 1, so it will exhibit high resistance. In addition, this first metal oxide film 2 has such a high degree of crystallinity that it consists of crystal grains that have grown to a large size.

The second metal oxide film 3 is deposited on the crystal surface of the first metal, oxide film 2, so the crystals in this second metal oxide film 3 will grow on top of the surfaces of the crystals in the first metal oxide film 2. For this reason, even if the second metal oxide film 3 is thin, no fine crystal grains will be precipitated and it remains highly crystalline and thermally stable.

Having undergone a high degree of crystallization, the first metal oxide film 2 has asperities in its surface, so an increased value of resistance will be obtained by growing the second metal oxide film 3 on this uneven surface of the first metal oxide film 2. Accordingly, even if the second metal oxide film 3, which governs the ultimate value of resistance of the resulting resistor, is formed in reduced thickness by applying material of a small specific resistance to the surface of the first metal oxide film 2, a desired resistor can be obtained that is thermally stable, has a high value of resistance and which has such a small temperature coefficient of resistance that small changes in resistance will occur even if it is exposed to the heat of soldering or if it is left to stand in a hot atmosphere.

It should be noted, however, that further investigation has revealed the following fact. The advantage of employing "double layers" as a combined metal oxide film resistor can also be enjoyed even when the thickness of the first layer is less than 0.1 μm. This phenomenon can be explained as follows. When the formation of a metal oxide film on a substrate proceeds, a so-called "Deadlayer" which is not fully crystalline first appears. As the formation of the layer proceeds further, crystallization gradually increases. Though the first layer at this stage is not fully crystalline, it is apparently helpful for the promotion of crystallization of the second layer which is applied on said first layer. The lower limit of the thickness of the first layer from this viewpoint can be set as being 0.02 μm, preferably 0.05 μm. Thus, it is concluded that in the practice of the present invention the thickness of the first metal oxide film may have an average thickness of 0.02-5 μm, preferably 0.05-2 μm.

The following examples are provided for the purpose of further illustrating the present invention but are in no way to be taken as limiting.

EXAMPLE 1

A thousand rods of mullite-corundum ceramic substrate (1.7 $mm^{\phi} \times 5.5\ mm^{L}$; ca. 70% alumina) were washed by sonication first in alcohol for 10 minutes, then in pure water for 15 minutes. After washing, the ceramic rods were dried with a dryer for 60 minutes at 170° C.

In a separate step, a mixed solution of pure water (1250 g) and ethyl alcohol (70 g) was provided and mixed with an aqueous solution (625 g) containing 60% of stannic chloride ($SnCl_4$). Iron chloride ($FeCl_3 \cdot 6H_2O$, 84.6 g) was dissolved in the resulting mixture to prepare a first feed solution.

Then, a mixed solution of pure water (1250 g), HCl (200 g) and ethyl alcohol (70 g) was provided and mixed with an aqueous solution (625 g) containing 60% of stannic chloride ($SnCl_4$). Antimony chloride ($SbCl_3$, 24.2 g) was dissolved in the resulting mixture to prepare a second feed solution.

Figure 3:
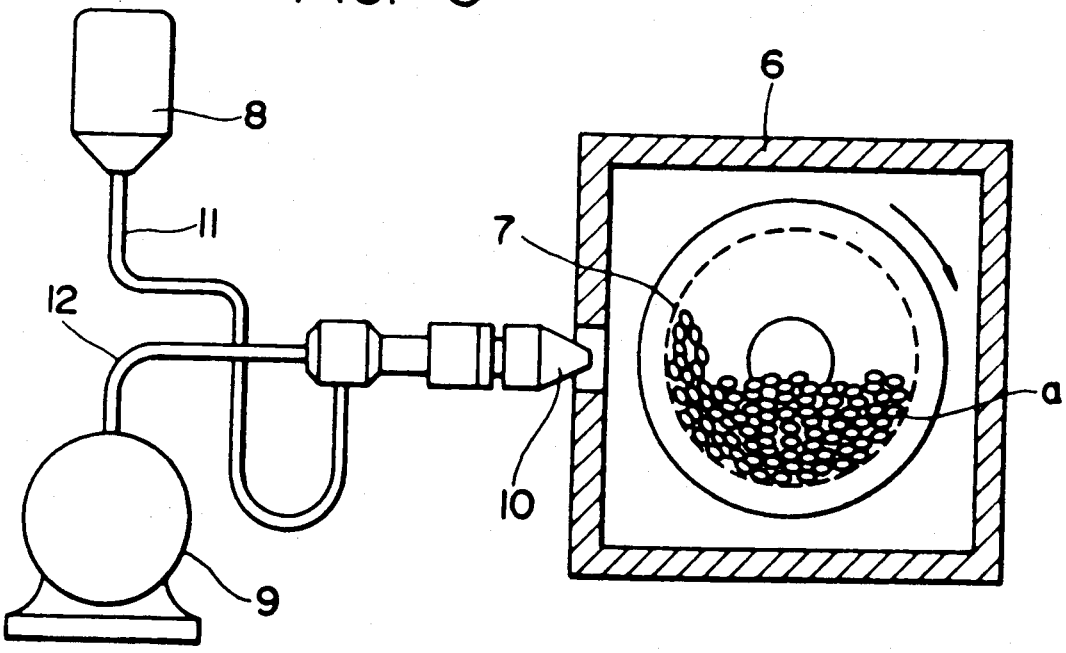
FIG. 3 is a partially cross-sectional schematic drawing of a film depositing apparatus that can be used to fabricate the metal oxide film resistor of the present invention.

After preparing the two feed solutions, the 1000 ceramic rods were charged into a drum in a film depositing apparatus the essential part of which is shown in FIG. 3. As the drum was rotated, the temperature in the furnace was elevated to 600° [C. With the furnace temperature held at 600° C., the first feed solution was charged into a feed solution supply unit 8 and a mist of the first feed solution was sprayed onto the ceramic rods through a nozzle 10 together with compressed air. After repeating the same procedure for the second feed solution, the spraying operation was turned off and the coated ceramic rods were furnace-cooled in the rotating drum.

After the furnace temperature became close to room temperature, the coated ceramic rods were taken out of the drum and film thickness measurements were conducted; the first metal oxide film 2 had an average thickness of 1 μm and the second metal oxide film 3 has an average thickness of $5 \times 10^{-3}$ μm.

Figure 2:
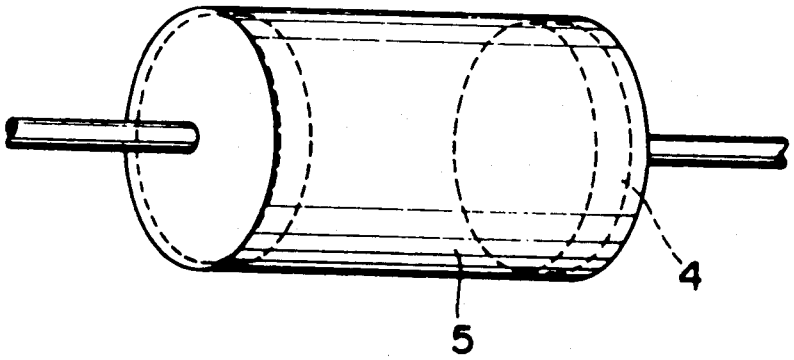
FIG. 2 is a perspective view of the same resistor.

The coated ceramic rods were heat-treated in a separate furnace at 200° C. for 2 hours. Thereafter, a metallic cap 4 (illustrated in FIGS. 1 and 2) with a wire lead was fitted over each end of an individual coated rod. The ceramic rods were then encapsulated with an insulating silicone resin coating 5 (illustrated in FIGS. 1 and 2) and heat-treated at 170° C. for 1 hour to cure the resin.

Four randomly selected groups each consisting of 200 resistors were subjected respectively to measurements of four parameters, i.e., the value of resistance at 20° C., the temperature coefficient of resistance, the change in the value of resistance upon exposure to the heat of soldering, and the change in the value of resistance upon standing in a hot atmosphere. All measurements were conducted by the four-terminal method.

The value of resistance at 20° C. was measured by the following method: 200 samples were left in a thermostatic chamber at 20° C. for 30 minutes and the measured values of resistance at 20° C. ($R_{20}$) were averaged. The results are shown in Table 1 after rounding the figures of tens to hundreds.

The change in the value of resistance after exposure to the heat of soldering was measured by the following method: after a measurement of the value of resistance at 20° C., 200 samples were submerged in a molten solder bath at 350° C. for 3 seconds; the recovered samples were left at room temperature for 3 hours and the values of their resistance were measured. The changes in the value of resistance from those measured at 20° C. were determined and a maximum of the changes in absolute value is shown in Table 1.

The temperature coefficient of resistance was measured by the following method: 200 samples were left in a thermostatic chamber at 20° C. for 30 minutes and the values of their resistance at 20° C. ($R_2O$) were measured; after adjusting the temperature in the thermostatic chamber to −55° C., the samples were held at that temperature for 30 minutes and the values of their resistance were measured; thereafter, the temperature in the thermostatic chamber was elevated to 155° C. and the values of resistance of the samples held at that temperature for 30 minutes were measured; the difference in the value of resistance ($\Delta R$) between 20° C. and 155° C. or between 20° C. and −55° C. was determined and the temperature coefficient of resistance (TCR) was calculated by the following formula:

$$TCR = (\Delta R / R_{20} \cdot \Delta T) \cdot 10^6 \text{ (ppm/°C.)}$$

where $\Delta T$ is the difference between 20° C. and the temperature of measurement.

With the temperature coefficient of resistance on both low- and high-temperature sides being determined in this way for 200 samples, a maximum TCR in absolute value is shown in Table 1.

The change in the value of resistance upon standing in a hot atmosphere was measured by the following method: 200 samples were first subjected to a measurement of resistance at 20° C.; thereafter, the samples were left in a thermostatic chamber at 200° C. for 100 hours; the recovered samples were then left at room temperature for 1 hour and the values of their resistance were measured. The changes in the value of resistance from those measured at 20° C. were determined and a maximum of the changes in absolute value is shown in Table 1.

EXAMPLES 2 AND 3

Treatments and measurements were conducted as in Example 1 except that the average thickness of the second metal oxide film was changed to $3 \times 10^{-3}$ μm (Example 2) or $5 \times 10^{-2}$ μm (Example 3). The results are shown in Table 1.

EXAMPLE 4

Treatments and measurement were conducted as in Example 1 except that 24.2 g of antimony chloride ($SbCl_3$) in the second feed solution was replaced by 43.3 g of nickel chloride ($NiCl_2 \cdot 6H_2O$) and that the second metal oxide film had an average thickness of $5 \times 10^{-2}$ μm. The results are shown in Table 1.

EXAMPLES 5-7

Treatments and measurements were conducted as in Example 1 except that the first metal oxide film had an average thickness of $5 \times 10^{-1}$ μm that the second metal oxide film had an average thickness of $5 \times 10^{-3}$ μm (Example 5), $3 \times 10^{-3}$ μm (Example 6) or $5 \times 10^{-2}$ μm (Example 7). The results are shown in Table 1.

EXAMPLE 8

Treatments and measurements were conducted as in Example 1 except that 24.2 g of antimony chloride ($SbCl_3$) in the second feed solution was replaced by 33.9 g of chromium chloride ($CrCl_3 \cdot 6H_2O$) and that the second metal oxide film had an average thickness of $5 \times 10^{-2}$ μm. The results are shown in Table 1.

EXAMPLE 9

Treatments and measurements were conducted as in Example 1 except that 84.6 g of iron chloride ($FeCl_3 \cdot 6H_2O$) in the first feed solution was replaced by 102 g of indium chloride ($InCl_3 \cdot nH_2O$; n = 3 − 4). The results are shown in Table 1.

COMPARATIVE EXAMPLE 1

Treatments and measurements were conducted as in Example 1 except that a second metal oxide film having a thickness of $5 \times 10^{-2}$ μm was directly formed on the surfaces of ceramic rods without forming the first metal oxide film. The results were as shown in Table 1.

TABLE 1

| Example No. | Resistance variance due to exposure to the heat of soldering (%) | Temperature coefficient of resistance (ppm/°C.) | Resistance at 20° C. (Ω) | Resistance variance due to standing in hot atmosphere (%) |
|---|---|---|---|---|
| 1 | 0.88 | 148 | 6500 | 3.46 |
| 2 | 2.41 | 342 | 12000 | 7.52 |
| 3 | 0.41 | 123 | 600 | 0.56 |
| 4 | 0.46 | 153 | 600 | 0.81 |
| 5 | 1.05 | 179 | 5600 | 4.17 |
| 6 | 2.69 | 411 | 10300 | 8.13 |
| 7 | 0.53 | 152 | 500 | 0.89 |
| 8 | 0.54 | 182 | 700 | 0.96 |
| 9 | 0.91 | 173 | 6200 | 3.53 |
| Comparative Example 1 | 10.43 | 306 | 420 | 7.21 |

n = 200

In Examples 1-9, the first feed solution was based on stannic chloride and contained either iron or indium as an auxiliary element. The practice of the present invention, however, is not limited to these cases and equally good results can be attained even if zinc, cadmium, antimony, nickel or phosphorus is incorporated as an auxiliary element.

In Examples 1-9, the second feed solution was based on stannic chloride and contained antimony, nickel or chromium as an auxiliary element. Equally good results can be attained even if fluorine, phosphorus, arsenic, iron, manganese, barium, bismuth, cobalt, zinc, copper, boron, cadmium or vanadium is incorporated as an auxiliary element. The ceramic substrates used in Examples 1-9 were rod-shaped (cylindrical) but this is not the only shape that can be assumed by the ceramic substrate and equally good results can be attained with any other shapes including a prism and a plate.

EXAMPLE 10

A thousand rods of mullite-corundum ceramic substrate (1.7 mm$^{\phi}$×5.5 mm$^{L}$; ca. 70% alumina) were washed by sonication first in alcohol for 10 minutes, then in pure water for 15 minutes. After washing, the ceramic rods were dried with a dryer for 60 minutes at 170° C.

In separate step, a mixed solution of pure water (1250 g) and ethyl alcohol (70 g) was provided and mixed with an aqueous solution (625 g) containing 60% of stannic chloride ($SnCl_4$). Nickel chloride ($NiCl_2 \cdot 6H_2O$, 29.5 g) was dissolved in the resulting mixture to prepare a first feed solution.

Then, a mixed solution of pure water (1250 g), HCl (200 g) and ethyl alcohol (70 g) was provided and mixed with an aqueous solution (625 g) containing 60% of stannic chloride ($SnCl_4$). Antimony chloride ($SbCl_3$, 24.2 g ) was dissolved in the resulting mixture to prepare a second solution.

After preparing the two feed solutions, the 1000 ceramic rods were charged into a drum in a film depositing apparatus the essential part of which is shown in FIG. 3. As the drum was rotated, the temperature in the furnace was elevated to 650° C. With the furnace temperature held at 650° C., the first feed solution was charged into a feed solution supply unit 8 and mist of the first feed solution was sprayed onto the ceramic rods through a nozzle 10 together with compressed air. After repeating the same procedure for the second feed solution, the spraying operation was turned off and the coated ceramic rods were furnace-cooled in the rotating drum.

After the furnace temperature became close to room temperature, the coated ceramic rods were taken out of the drum and film thickness measurements were conducted; the first metal oxide film had an average thickness of 1 μm and the second metal oxide film had an average thickness of $1\times10^{-2}$ μm.

The coated ceramic rods were heat-treated in a separate furnace at 200° C. for 2 hours. Thereafter, a metallic cap with a wire lead was fitted over each end of an individual coated rod. The ceramic rods were then encapsulated with an insulating silicone resin and heat-treated at 170° C. for 1 hour to cure the resin.

Four randomly selected groups each consisting of 200 resistors were subjected respectively to measurements of four parameters, i.e., the value of resistance at 20° C., the temperature coefficient of resistance, the change in the value of resistance upon exposure to the heat of soldering, and the change in the value of resistance upon standing in a hot atmosphere. All measurements were conducted by the four-terminal method.

The change in the value of resistance upon standing in a hot atmosphere was measured by the following method 200 samples were first subjected to a measurement of resistance at 20° C.; thereafter, the samples were left in a thermostatic chamber at 200° C. for 100 hours; the recovered samples were then left at room temperature for 1 hour and the values of their resistance were measured. The changes in the value of resistance from those measured at 20° C. were determined and a maximum of the changes in absolute value is shown in Table 2.

EXAMPLES 11-14

Treatments and measurements were conducted as in Example 10 except that the amount of nickel chloride ($NiCl_2 \cdot 6H_2O$) incorporated in the first feed solution was changed to 3.9 g (Example 11), 14.8 g (Example 12), 59.0 g (Example 13) or 73.8 g (Example 14). The results are shown in Table 2.

EXAMPLE 15

Treatments and measurements were conducted as in Example 10 except that 29.5 g of nickel chloride ($NiCl_2 \cdot 6H_2O$) in the first feed solution was replaced by 25.4 g of phosphorus pentachloride ($PCl_5$). The results are shown in Table 2.

EXAMPLE 16

Treatments and measurements were conducted as in Example 10 except that 14.5 g of phosphorus pentachloride ($PCl_5$) was additionally incorporated in the first feed solution. The results are shown in Table 2.

EXAMPLE 17

Treatments and measurements were conducted as in Example 10 except that the amount of nickel chloride ($NiCl_2 \cdot 6H_2O$) incorporated in the first feed solution was changed to 14.8 g and that 17.2 g of iron chloride ($FeCl_3 \cdot 6H_2O$) was additionally incorporated in the first feed solution. The results are shown in Table 2.

EXAMPLE 18

Treatments and measurements were conducted as in Example 10 except that the thickness of the second metal oxide film was changed to $5\times10^{-3}$ μm results are shown in Table 2.

EXAMPLE 19

Treatments and measurements were conducted as in Example 10 except that 26.7 g of ammonium fluoride ($NH_4F$) was additionally incorporated in the second feed solution. The results are shown in Table 2.

COMPARATIVE EXAMPLE 2

Treatments and measurements were conducted as in Example 10 except that a second metal oxide film having a thickness of $5\times10^{-2}$ μm was directly formed on the surfaces of ceramic rods without forming the first metal oxide film. The results are shown in Table 2.

EXAMPLE 20

Treatments and measurements were conducted as in Example 10 except that the first metal oxide film had an average thickness of $5\times10^{-2}$ μm second metal oxide film had an average thickness of $5\times10^{-2}$ μm. The results are shown in Table 2.

| Example No. | Resistance at 20° C. (Ω) | Temperature coefficient of resistance (ppm/°C.) | Resistance variance due to exposure to the heat of soldering (%) | Resistance variance due to standing in hot atmosphere (%) |
|---|---|---|---|---|
| 10 | 3200 | 105 | 0.55 | 1.25 |
| 11 | 3300 | 122 | 0.43 | 1.09 |
| 12 | 3300 | 114 | 0.47 | 1.13 |
| 13 | 3100 | 91 | 0.68 | 1.52 |
| 14 | 2900 | 56 | 0.74 | 1.78 |
| 15 | 3000 | 63 | 0.51 | 1.17 |
| 16 | 3100 | 65 | 0.59 | 1.34 |
| 17 | 3000 | 65 | 0.60 | 1.31 |
| 18 | 6100 | 133 | 0.82 | 3.39 |
| 19 | 3000 | 88 | 0.53 | 1.20 |
| 20 | 500 | 153 | 1.02 | 2.40 |

BEST AVAILABLE COPY

-continued

| Example No. | Resistance at 20° C. (Ω) | Temperature coefficient of resistance (ppm/°C.) | Resistance variance due to exposure to the heat of soldering (%) | Resistance variance due to standing in hot atmosphere (%) |
|---|---|---|---|---|
| Comparative Example 2 | 400 | 264 | 8.31 | 6.48 |

If the amounts of the elements incorporated in the first metal oxide film in addition to tin are extremely small, the specific resistance of the first metal oxide film is reduced and the difference in the value of resistance between the first and second metal oxide films becomes so small that the effect of the first film predominates over that of the second film to increase the temperature coefficient of the resistance of the combined film. If the amounts of elements other than tin incorporated in the first metal oxide film are excessive, the crystallinity and hence, the thermal stability, of the first film are reduced to cause increased variations in the resistance of the device upon exposure to the heat of soldering or during standing in a hot atmosphere.

In Examples 10–19, the first feed solution was based on tin chloride and contained either nickel, phosphorus, nickel + phosphorus, phosphorus, or nickel + iron as additional elements. The embodiments of the present invention, however, are not limited to these cases and equally good results can be attained if at least one element selected from the group consisting of iron, indium, nickel, phosphorus, zinc, cadmium and antimony is incorporated as an auxiliary element. Particularly good results are obtained if the additional element is at least one of iron, indium, nickel and phosphorus.

In Examples 10–19, the second feed solution was based on tin chloride and contained antimony as an additional element. The embodiments of the present invention, however, are not limited to this case alone and equally good results can be attained if at least one element selected from the group consisting of antimony, nickel, chromium, fluorine, phosphorus, arsenic, iron, manganese, barium, bismuth, cobalt, zinc, copper, boron, cadmium and vanadium is incorporated as an additional element. Particularly good results are obtained if the additional element is at least one of antimony, fluorine, nickel and chromium.

The ceramic substrates used in Examples 10–19 were rod-shaped (cylindrical) but this is not the only shape that can be assumed by the ceramic substrate and equally good results can be attained with any other shapes including a prism and a plate.

In Examples 10–19, a "spray method" was used to deposit first and second metal oxide films on the ceramic substrate, but it should be understood that equally good results can be attained by blowing against the substrate air-borne fine particles of the feed solutions produced by a sonic atomizer. Other methods that can be used with similar good results are CVD and sputtering processes.

The metal oxide film resistor of the present invention offers the following advantages it can be designed to have a resistance which is several tens of times as high as the value previously attained by conventional metal oxide film resistors; it is highly heat-stable and will experience only small changes in resistance upon exposure to the heat of soldering or during standing in a hot atmosphere. Because of these advantages, the resistor of the present invention will offer great benefits to the electronics industry not only by expanding the scope of applications of metal oxide film resistors but also by improving their reliability.

We claim:

1. A metal oxide film resistor comprising a ceramic substrated coated with a metal oxide film comprising tin oxide and connecting terminals attached to the surface of said metal oxide film, said metal oxide film comprising a first metal oxide film layer having a thickness of 0.1–5 μm that is in direct contact with the surface of said ceramic substrate and a second metal oxide film layer having a thickness of 0.003–1 μm that is coated on said first metal oxide film layer and which has a lower specific resistance than said first metal oxide film layer:

said first metal oxide film layer comprising tin oxide as a main component and at least one element, as an auxiliary component for increasing the specific resistance of the first metal oxide layer without impairing its crystallinity, selected from the group consisting of iron, indium, nickel and phosphorus; and said second metal oxide film layer comprising tin oxide as a main component and at least one element, as an auxiliary component for adjusting the specific resistance of the second layer without impairing its crystallinity, selected from the group consisting of antimony, nickel, chromium, fluorine, phosphorus, arsenic, iron, manganese, barium, bismuth, cobalt, zinc, copper, boron, cadmium and vanadium.

2. The metal oxide film resistor of claim 1, wherein said first metal oxide film layer has a thickness of 0.5–2 μm.

3. The metal oxide film resistor of claim 1, wherein said auxiliary component of said second metal oxide film layer is at least one element selected from the group consisting of antimony, nickel, fluorine and chromium.

4. The metal oxide film resistor of claim 2, wherein said auxiliary component of said second metal oxide film layer is at least one element selected from the group consisting of antimony, nickel, fluorine and chromium.

5. The metal oxide film resistor of claim 3, wherein said auxiliary component of said second metal oxide film layer is at least one element selected from the group consisting of antimony, nickel and chromium.

6. The metal oxide film resistor of claim 4, wherein said auxiliary component of said second metal oxide film layer is at least one element selected from the group consisting of antimony, nickel and chromium.

7. The metal oxide film resistor of claim 5, wherein said second metal oxide film layer has a thickness of 0.005–0.5 μm.

8. The metal oxide film resistor of claim 6, wherein said second metal oxide film layer has a thickness of 0.005–0.5 μm.

9. The metal oxide film resistor of claim 1, wherein said metal oxide film consists of said first metal oxide film layer and said second metal oxide film layer.

10. The metal oxide film resistor of claim 8, wherein said metal oxide film consists of said first metal oxide film layer and said second metal oxide film layer.

11. The metal oxide film resistor of claim 2, wherein in said first metal oxide film layer, the tin atoms are in a ratio to the total number of auxiliary component atoms of 1:0.001 to 1:0.41 and in said second metal oxide film layer, the tin atoms are in a ratio to the total number of auxiliary component atoms of 1:0.0001 to 1:0.2.

12. The metal oxide film resistor of claim 2, wherein in said first metal oxide film layer, the tin atoms are in a ratio to the total number of auxiliary component atoms of 1:0.003 to 1:0.15; and in said second metal oxide film layer, the tin atoms are in a ratio to the total number of auxiliary component atoms of 1:0.005 to 1:0.1.

13. The metal oxide film resistor of claim 5, wherein in said first metal oxide film layer, the tin atoms are in a ratio to the total number of auxiliary component atoms of 1:0.003 to 1:0.15; and in said second metal oxide film layer, the tin atoms are in a ratio to the total number of auxiliary component atoms of 1:0.005 to 1:0.1.

14. The metal oxide film resistor of claim 6, wherein in said first metal oxide film layer, the tin atoms are in a ratio to the total number of auxiliary component atoms of 1:0.003 to 1:0.15; and in said second metal oxide film layer, the tin atoms are in a ratio to the total number of auxiliary component atoms of 1:0.005 to 1:0.1.

15. The metal oxide film resistor of claim 7, wherein in said first metal oxide film layer, the tin atoms are in a ratio to the total number of auxiliary component atoms of 1:0.003 to 1:0.15; and in said second metal oxide film layer, the tin atoms are in a ratio to the total number of auxiliary component atoms of 1:0.005 to 1:0.1.

16. The metal oxide film resistor of claim 8, wherein in said first metal oxide film layer, the tin atoms are in a ratio to the total number of auxiliary component atoms of 1:0.003 to 1:0.15; and in said second metal oxide film layer, the tin atoms are in a ratio to the total number of auxiliary component atoms of b 1:0.005 to 1:0.1.

17. The metal oxide film resistor of claim 1, wherein said first metal oxide film layer contains iron as the auxiliary component and said second metal oxide film layer contains antimony as the auxiliary component.

18. The metal oxide film resistor of claim 8, wherein said first metal oxide film layer contains iron as the auxiliary component and said second metal oxide film layer contains antimony as the auxiliary component.

19. The metal oxide film resistor of claim 12, wherein said first metal oxide film layer contains iron as the auxiliary component and said second metal oxide film layer contains antimony as the auxiliary component.

20. The metal oxide film resistor of claim 14, which consists of said first metal oxide film layer and of said second film layer and wherein said first metal oxide film layer contains iron as the auxiliary component and said second metal oxide film layer contains antimony as the auxiliary component.

21. The metal oxide film resistor of claim 16 which consists of said first metal oxide film layer and of said second film layer and wherein said first metal oxide film layer contains iron as the auxiliary component and said second metal oxide film layer contains antimony as the auxiliary component.

22. The metal oxide film resistor of claim 21, wherein said first metal oxide film layer has an average thickness of 1 $\mu$m and said second metal oxide film layer has an average thickness $5 \times 10^3$ $\mu$m.

23. The metal oxide film resistor of claim 16, wherein said first metal oxide film layer has an average thickness of 1 $\mu$m and said second metal oxide film layer has an average thickness $5 \times 10^3$ $\mu$m.

* * * * *